United States Patent [19]

Rasmussen

[11] Patent Number: 5,011,455

[45] Date of Patent: Apr. 30, 1991

[54] COIN SORTER WITH AUTOMATIC BAG-SWITCHING

[75] Inventor: James M. Rasmussen, Chicago, Ill.

[73] Assignee: Cummins-Allison Corporation, Mt. Prospect, Ill.

[21] Appl. No.: 478,341

[22] Filed: Feb. 12, 1990

[51] Int. Cl.[5] ..... G07D 3/16

[52] U.S. Cl. ..... 453/010; 453/32

[58] Field of Search ..... 453/6, 10, 31, 32; 221/7

[56] References Cited

U.S. PATENT DOCUMENTS

| | | |
|---|---|---|
| 2,109,658 | 3/1938 | Zierick . |
| 3,902,511 | 9/1975 | Jacobs . |
| 3,939,954 | 2/1976 | Collins : |
| 4,086,928 | 5/1978 | Ristvedt et al. . |
| 4,098,280 | 7/1978 | Ristvedt et al. . |
| 4,111,216 | 9/1978 | Brisebarre . |
| 4,234,003 | 11/1980 | Ristvedt et al. . |
| 4,444,212 | 4/1984 | Ristvedt et al. . |
| 4,506,685 | 3/1985 | Childers et al. . |
| 4,531,531 | 7/1985 | Johnson et al. . |
| 4,549,561 | 10/1985 | Johnson et al. . |
| 4,557,282 | 12/1985 | Childers et al. . |
| 4,564,036 | 1/1986 | Ristvedt . |
| 4,681,128 | 7/1987 | Ristvedt et al. . |
| 4,731,043 | 3/1988 | Ristvedt et al. . |
| 4,775,354 | 10/1988 | Rasmussen et al. . |

FOREIGN PATENT DOCUMENTS

| | | |
|---|---|---|
| 0061302 | 9/1982 | European Pat. Off. . |
| 0136774 | 4/1985 | European Pat. Off. . |
| 2346780 | 10/1977 | France . |
| 650871 | 8/1985 | Switzerland . |
| 2060970 | 5/1981 | United Kingdom . |

OTHER PUBLICATIONS

Advertisement, "A1-1500 'Pulsar'".

Childers Corporation Advertisement "Childers Magnum".

*Primary Examiner*—F. J. Bartuska

*Attorney, Agent, or Firm*—Arnold, White & Durkee

[57] ABSTRACT

A coin sorter comprises a rotatable disc having a resilient surface for receiving mixed denomination coins and imparting rotational movement to the coins, and a drive motor for rotating the disc. A stationary guide plate having a contoured surface is spaced slightly away from and generally parallel to the resilient surface of said rotatable disc; the guide plate includes an area for queuing the coins on the disc into a single file of coins, and a guiding edge which engages selected edges of the coins in the single file and guides the coins along a prescribed path where the positions of the engaged edges of the coins are determined by the diameters of the respective coins. A sorting area discriminates among coins of different denominations and selects coins of different denominations for discharge from the rotating disc at different locations around the periphery of the guide plate. The sorting area includes at least two different selectors for a prescribed coin denomination for discharging coins of that prescribed denomination at two different locations around the periphery of the guide plate. A controllably actuatable shunt is associated with the first of the two different selectors for shunting coins of the prescribed denomination past the first of the two different selectors to the second of the two different selectors so that the coins are discharged at the second of the two different locations.

8 Claims, 9 Drawing Sheets

121
HAS NICKEL LIMIT BEEN REACHED ?
NO
YES
124
HAS HALF DOLLAR LIMIT BEEN REACHED ?
NO
YES
122
ENERGIZE SOLENOIDS SB & SD
123
STOP MOTOR & DE-ENERGIZE SOLENOIDS SB & SD
125
HAS QUARTER LIMIT BEEN REACHED ?
NO
YES
126
HAS TOKEN LIMIT BEEN REACHED ?
NO
YES
127
IS BAG A FULL ?
YES
128
IS BAG B AVAILABLE ?
NO
129
YES
ENERGIZE SOLENOID SQ
NO
130
IS BAG A AVAILABLE ?
131
YES
DE-ENERGIZE SOLENOID SQ

COIN SORTER WITH AUTOMATIC BAG-SWITCHING

FIELD OF THE INVENTION

The present invention relates generally to coin sorting devices and, more particularly, to coin sorters of the type which use a resilient disc rotating beneath a stationary sorting head for sorting coins of mixed denominations. This invention specifically relates to coin sorters having a "bag-switching" feature which permits a full bag of coins of a particular denomination to be removed from one location on the sorter while coins of that same denomination continue to be sorted and discharged into another bag at a different location.

DESCRIPTION OF RELATED ART

"Bag-switching" is a well known feature for coin sorters which are intended to handle a large volume of coins of one or more denominations. For example, telephone companies and casinos often need to sort large volumes of coins of only three or four denominations. The coin throughput rate is increased by a "bag-switching" feature which reduces the down time of the sorter, or even allows the sorter to continue running and sorting, while full bags of coins are removed from the sorter and replaced with empty bags. For example, the coin discharge chute may have two branches leading to two different bag locations, with a gate inside the chute controlling which branch receives sorted coins at any given time.

Bag-switching devices used in the prior art have been located outside the sorting head and downstream of the sensors for the coin counters Consequently, all the coins of a given denomination are counted by the same sensor, upstream of the switching mechanism that determines which bag receives the counted coins. As a result, the count accumulated for a given bag might not be accurate because there are always a few coins that could end up in either bag, depending upon the timing of the physical movement of the switching mechanism relative to the sensing of the coin count that triggers the switching mechanism.

In applications where it is desired to avoid such inaccuracies, the sorter is stopped during the time the switching mechanism is being moved, and then the sorter is restarted. This procedure ensures that each full bag always contains at least the desired number of coins, and the counter always indicates exactly how many coins are in that bag so that any excess coins can be removed. Of course, such repeated stopping and starting reduces the coin throughput rate, and also increases the wear and tear on the sorter.

Another problem with previous bag-switching devices has been the need for the switching mechanism to intrude directly into the path of a virtually continuous stream of coins in free flight, within the guide chutes that guide the coins from the sorter to the bag stations. The coins thus impact directly on the movable gate or diverter portion of the switching mechanism, which can cause jams, particularly when the path of the coins must be changed significantly in order to direct the coins to the second bag. The repeated impacts of the coins on the switching mechanism also abrade both the coins and the switching mechanism.

SUMMARY OF THE INVENTION

It is a primary object of the present invention to provide an improved coin sorter which enables the bag-switching mechanism to be located upstream of the coin counters so that the coins directed to each bag can be separately counted. In this connection, a related object of the invention is to provide an improved bag-switching system which permits the sorter to operate continuously during bag-switching, at least for selected coin denominations.

Another related object of this invention is to provide an improved bag-switching system which improves the coin throughput rate, and thus the productivity, of the sorter.

It is another important object of this invention to provide an improved coin sorter which permits the bag-switching function to be carried out within the sorting head rather than outside the head.

Still another object of this invention is to provide an improved coin sorter with a bag-switching mechanism which virtually eliminates the possibility of coin jams between the sorting head and the various bag stations.

A further object of this invention is to provide an improved coin sorter which can be made small enough for countertop use and yet have a bag-switching capability.

Other objects and advantages of the invention will be apparent from the following detailed description and the accompanying drawings.

In accordance with the present invention, the foregoing objectives are realized by providing a coin sorter which comprises a rotatable disc having a resilient surface for ~~rec~~eiving mixed denomination coins and imparting rotational movement to the coins; means for rotating the disc; a stationary guide plate having a contoured surface spaced slightly away from and generally parallel to the resilient surface of said rotatable disc, the guide plate including means for queuing the coins on the disc into a single file of coins, and a guiding edge which engages selected edges of the coins in the single file and guides the coins along a prescribed path where the positions of the engaged edges of the coins are determined by the diameters of the respective coins; sorting means for discriminating among coins of different denominations and selecting coins of different denominations for discharge from the rotating disc at different locations around the periphery of the guide plate, the sorting mean including at least two different selecting means for a prescribed coin denomination for discharging coins of that prescribed denomination at two different locations around the periphery of the guide plate; and controllably actuatable shunting means associated with the first of the two different selecting means for shunting coins of the prescribed denomination past the first of the two different selecting means to the second of the two different selecting means so that the coins are discharged at the second of the two different locations.

In one preferred embodiment of the invention, the selecting means comprises a plurality of exit slots formed by the guide plate and spaced around the periphery thereof with the inner ends of the slots located at different radial positions for receiving and discharging coins of different denominations, and the shunting means comprises a retractable bridge disposed within the first of two different exit slots for coins of the prescribed denomination, at the inner end of the slot, the bridge preventing the entry of coins into the first slot when the bridge is in its advanced position.

DESCRIPTION OF THE PREFERRED EMBODIMENTS

Figure 1:
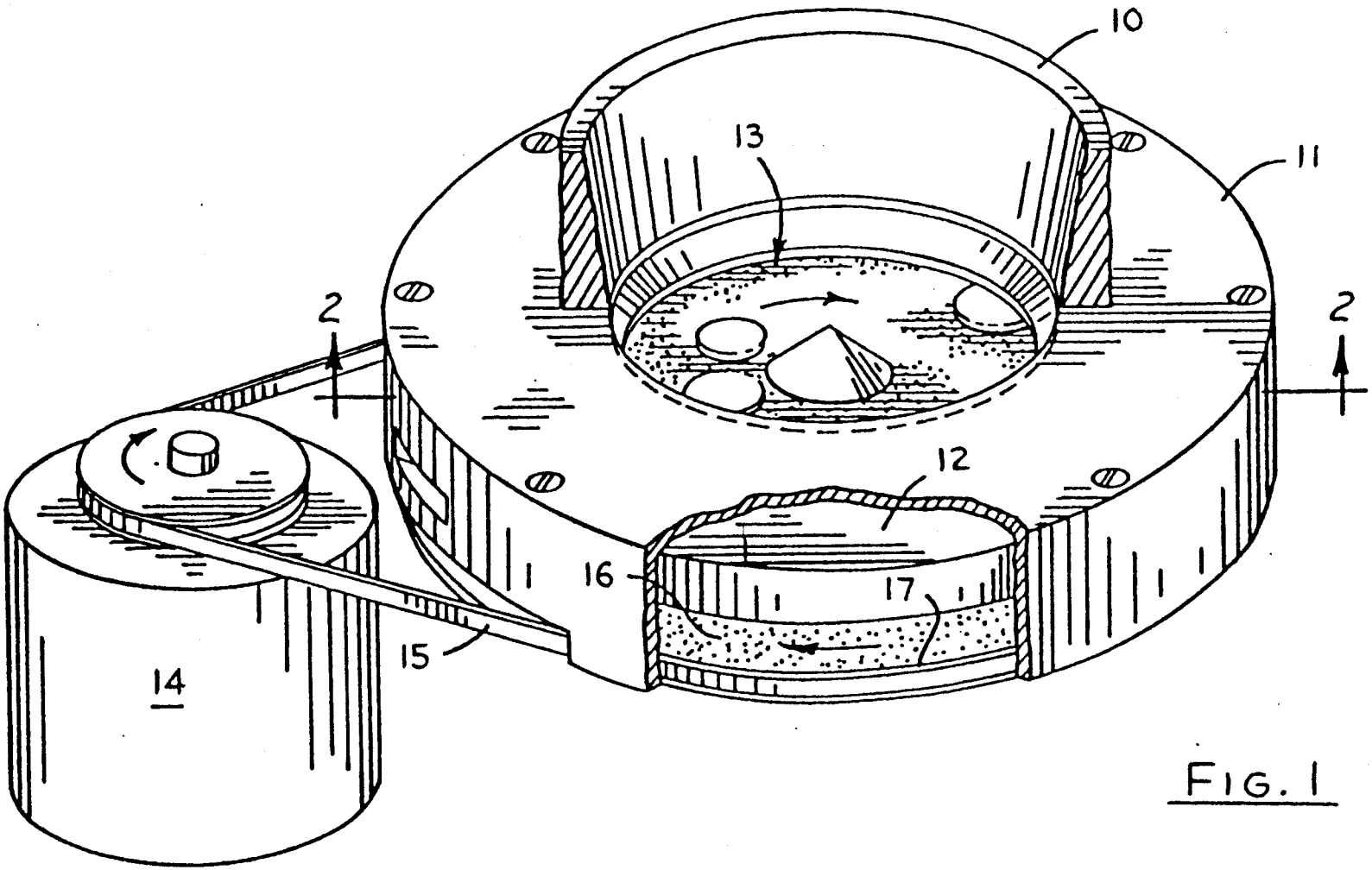
FIG. 1 is perspective view of a coin sorter embodying the present invention, with portions thereof broken away to show the internal structure.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings and referring first to FIG. 1, a hopper 10 receives coins of mixed denominations and feeds them through central openings in a housing 11 and an annular sorting head or guide plate 12 inside the housing. As the coins pass through these openings, they are deposited on the top surface of a rotatable disc 13. This disc 13 is mounted for rotation on a stub shaft (not shown) and driven by an electric motor 14 via drive belt 15. The disc 13 comprises a resilient pad 16, preferably made of a resilient rubber or polymeric material, bonded to the top surface of a solid metal disc 17.

As the disc 13 is rotated, the coins deposited on the top surface thereof tend to slide outwardly over the surface of the pad due to centrifugal force. As the coins move outwardly, those coins which are lying flat on the pad enter the gap between the pad surface and the guide plate 12 because the underside of the inner periphery of this plate is spaced above the pad 16 by a distance which is about the same as the thickness of the thickest coin.

Figure 2:
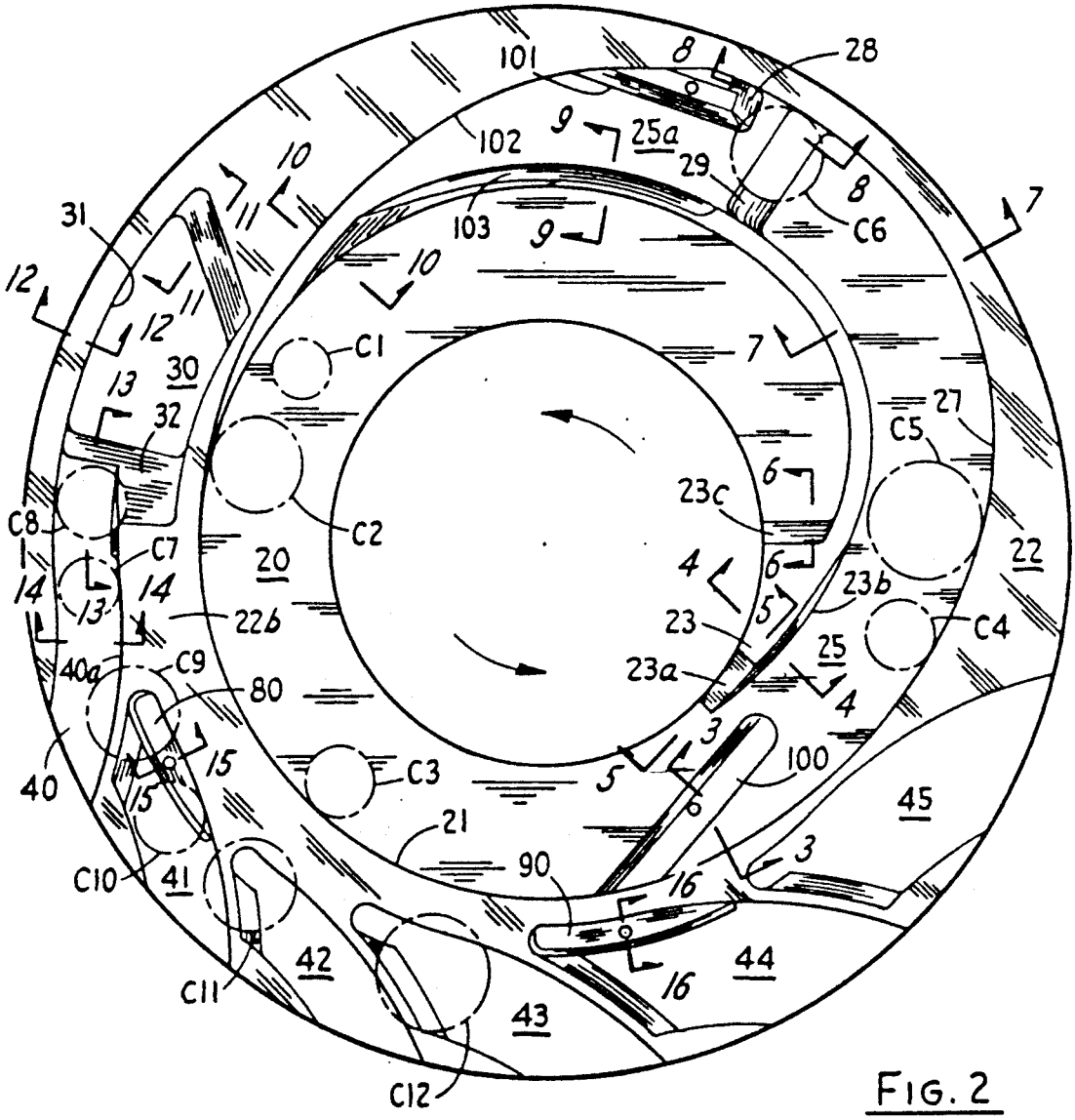
FIG. 2 is an enlarged horizontal section taken generally along the line 2—2 in FIG. i to show the configuration of the underside of the sorting head or guide plate.

As can be seen most clearly in FIG. 2, the outwardly moving coins initially enter an annular recess 20 formed in the underside of the guide plate 12 and extending around a major portion of the inner periphery of the annular guide plate. Coins C1, C2 and C3 superimposed on the bottom plan view of the guide plate in FIG. 2 are examples of coins which have entered the peripheral recess 20. The outer wall 21 of the recess 20 extends downwardly to the lowermost surface 22 of the guide plate, which is spaced from the top surface of the pad 16 by a distance which is slightly less, e.g., 0.010 inch, than the thickness of the thinnest coins. Consequently, the initial radial movement of the coins is terminated when they engage the wall 21 of the recess 20, though the coins continue to move circumferentially along the wall 21 by the rotational movement of the pad !6, as indicated by the arrows in FIG. 2.

Figure 4:
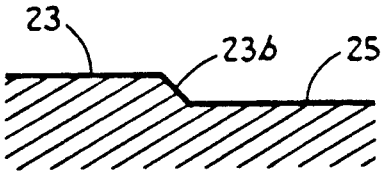
FIG. 4 is an enlarged section taken generally along line 4—4 in FIG. 2.
Figure 5:
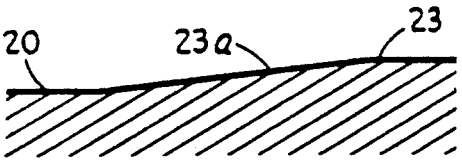
FIG. 5 is an enlarged section taken generally along line 5—5 in FIG. 2.
Figure 6:
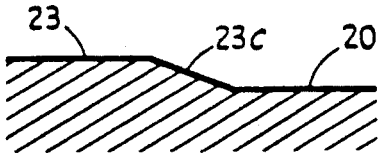
FIG. 6 is an enlarged section taken generally along line 6—6 in FIG. 2.

The only portion of the central opening of the guide plate 12 which does not open directly into the recess 20 is that sector of the periphery which is occupied by a land 23 whose lower surface is only slightly (e.g., 0.030 inch) above the lowermost surface 22 of the guide plate. The upstream end of the land 23 forms a ramp **23*a* (FIG. 5), the outboard side of the land forms a beveled wall 23*b* (FIG. 4), and the downstream end of the land forms a ramp 23*c* (FIG. 6). The purpose of the land 23** will be described in more detail below.

Figure 7:
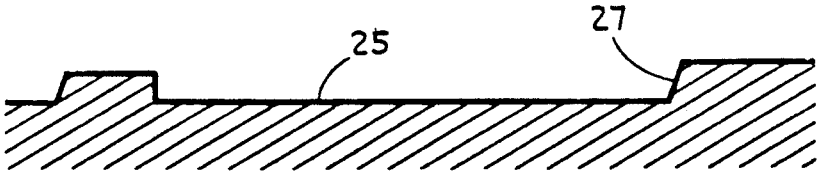
FIG. 7 is an enlarged section taken generally along line 7—7 in FIG. 2.
Figure 8:
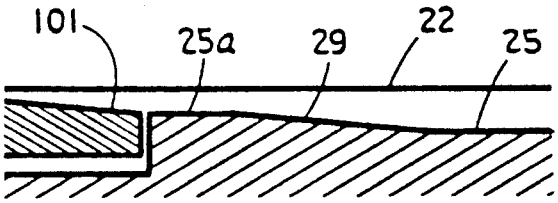
FIG. 8 is an enlarged section taken generally along line 8—8 in FIG. 2.

As coins within the recess 20 approach the land 23, those coins move outwardly around the land 23 through a recess 25 which is merely an outward extension of the inner peripheral recess 20. In FIG. 2, coins C4 and C5 are examples of coins moving in succession through the recess 25, which is preferably just slightly wider than the diameter of the coin denomination having the greatest diameter. Just as the recess 25 is an extension of the peripheral recess 20, the outer wall 27 of the recess 25 is an extension of the outer wall 21 of the recess 20. Thus, coins which approach the recess 25 with their outer edges riding on the wall 21 move into the recess 25 with their outer edges riding on the outer wall 27, as illustrated by the coins C4 and C5 in FIG. 2. As can be seen in the sectional view in FIG. 7, the wall 27 is preferably tapered to minimize abrasion by minimizing the area of contact between the coins and the recess wall.

Rotation of the pad 16 continues to move the coins along the wall 27 until the outer portions of those coins engage a capturing ramp 28 sloping downwardly from a shallower region 25*a* of the recess 25 to a region 22*a* of the lowermost surface 22 of the guide plate 12. The shallower region 25*a*, which begins at a ramp 29 just upstream of the ramp 28, further stabilizes the coins before they engage the ramp 28. Coin C6 in FIG. 2 is an example of a coin which has just engaged the ramp 28. Because the surface 22 is spaced from the pad 16 by a distance that is less than the thickness of the thinnest coin, the effect of the ramp 28 is to depress the outer edge of any coin that engages the ram downwardly into the resilient pad 16 as the coins are advanced along the ramp by the rotating disc. This causes the coins to be firmly gripped between the guide plate surface region 22*a* and the resilient pad 16, thereby holding the coins in a fixed radial position as they continue to be rotated along the underside of the guide plate by the rotating disc.

Even though only a small portion of the surface area of any given coin is gripped between the guide plate surface region 22*a* and the resilient pad 16, the compressive gripping force is sufficient to hold the coins in a fixed radial position. In fact, gripping the coins along a segment which is only about one millimeter wide is sufficient to hold the coins against radial movement, while they are being rotated along the underside of the guide plate by the rotating disc.

Figure 9:
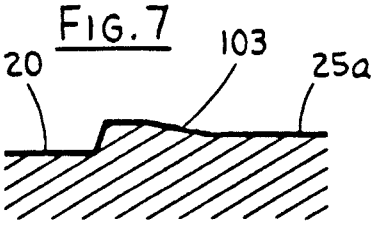
FIG. 9 is an enlarged section taken generally along line 9—9 in FIG. 2.
Figure 10:
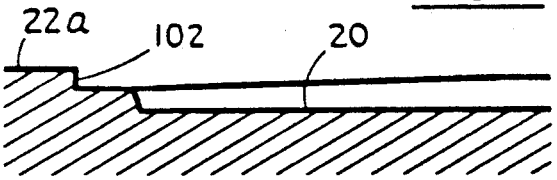
FIG. 10 is an enlarged section taken generally along line 10—10 in FIG. 2.

Coins which have not moved outwardly far enough to engage the ramp 28 continue past the ramp and engage an inwardly spiralling wall !02 which guides the coins back to the recess 20. A tapered surface 103 (FIGS. 2 and 9) along the inner edge of the recess 25*a* tips the leading edges of such coins upwardly to ensure that the coins are intercepted by the wall 102. Thus, such coins are recycled and ultimately enter the queuing channel 25 again.

Figure 11:
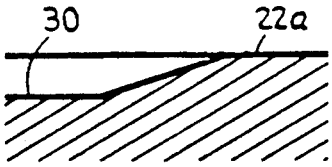
FIG. 11 is an enlarged section taken generally along line 11—11 in FIG. 2.
Figure 12:
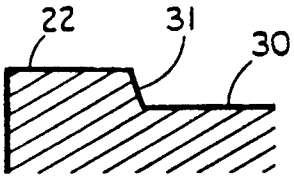
FIG. 12 is an enlarged section taken generally along line 12—12 in FIG. 2.

As the coins continue to be rotated along region 22*a* of the guide plate surface, they enter a referencing recess 30 (FIGS. 2 and 11) whose top surface is spaced away from the top of the pad 16 by a distance that is greater than the thickness of the thickest coin so that the coins are not gripped between the guide plate 12 and the resilient pad 16 as they are rotated through the referencing recess 30. The referencing recess 30 forms a tapered outer wall 31 (FIG. 12) which engages and precisely positions the outer edges of the coins just before the coins reach the exit channels which serve as means for discriminating among coins of different denominations according to their different diameters.

The reason for the referencing recess 30 is that certain coins may be captured by the ramp 28 even though they are not actually engaging the outer wall 27 of the recess 25. That is, the outer edge of a coin may be slightly spaced from the outer wall 27 as the coin engages the ramp 28, and yet that coin might still overlap a sufficient portion of the ramp 28 to become gripped between the guide plate surface 22 and the resilient pad 16. Within the recess 30 all coins are free to move radially outwardly against the wall 31 to ensure that the outer edges of all the coins are located at a common radial position, regardless of where the outer edges of those coins were located when they were initially captured by the ramp 28.

Figure 13:
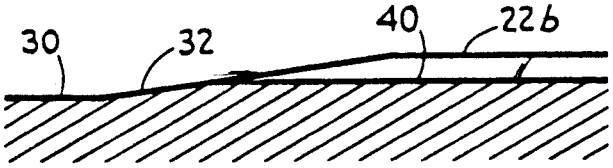
FIG. 13 is an enlarged section taken generally along line 13—13 in FIG. 2.

At the downstream end of the referencing recess 30, a gentle ramp 32 (FIG. 13) slopes downwardly from the top surface of the referencing recess 30 to region 22*b* of the lowermost surface 22 of the guide plate. Thus, the coins are gripped between the guide plate 12 and the resilient pad 16 with the maximum compressive force. This ensures that the coins are held securely in the radial position determined by the wall 31 of the referencing recess 30.

Beyond the referencing recess 30, the guide plate 12 forms a series of exit channels 40, 41, 42, 43, 44 and 45 which function as selecting means to discharge coins of different denominations at different circumferential locations around the periphery of the guide plate. Thus, the channels 40–45 are spaced circumferentially around the outer periphery of the plate 12, with the innermost edges of successive channels located progressively farther away from the common radial location of the outer edges of all coins for receiving and ejecting coins in order of increasing diameter. In the particular embodiment illustrated, the six channels 40–45 are positioned and dimensioned to eject nickels (channel 40), quarters (channels 41 and 42), half dollars (channel 43) and casino tokens (channels 44 and 45). As used herein, the term "coins" includes tokens. The innermost edges of the exit channels 40–45 are positioned so that the inner edge of a coin of only one particular denomination can enter each channel; the coins of all other denominations reaching a given exit channel extend inwardly beyond the innermost edge of that particular channel so that those coins cannot enter the channel and, therefore, continue on to the next exit channel.

For example, the first exit channel 40 (FIGS. 2 and 14) is intended to discharge only nickels, and thus the innermost edge 40*a* of this channel is located at a radius that is spaced inwardly from the radius of the referencing wall 31 by a distance that is only slightly greater than the diameter of a nickel. Consequently, only nickels can enter the channel 40. Because the outer edges of all denominations of coins are located at the same radial position when they leave the referencing recess 30, the inner edges of the quarters, half dollars and casino tokens all extend inwardly beyond the innermost edge 40*a* of the channel 40, thereby preventing these coins from entering that particular channel. This is illustrated in FIG. 2 which shows a nickel C7 captured in the channel 40, while a quarter C8 and half dollar C9 are bypassing the channel 40 because their inner edges extend inwardly beyond the innermost edge 40*a* of the channel so that they remain gripped between the guide plate surface 22*b* and the resilient pad 16.

Of the coins that reach channel 41, the inner edges of only the quarters are located close enough to the periphery of the guide plate 12 to enter that exit channel.

The inner edges of all the larger coins extend inwardly beyond the innermost edge of the channel 41 so that they remain gripped between the guide plate and the resilient pad. Consequently, all the coins except the quarters are rotated past the channel 41 and continue on to the next exit channel. This is illustrated in FIG. 2 which shows a quarter C10 captured in the channel 41, while a half dollar C11 is bypassing the channel 41 because the inner edge of the half dollar extends inwardly beyond the innermost edge 41*a* of the channel.

Similarly, only quarters can enter the exit channel 42, only half dollars can enter the channel 43, and only casino tokens can enter the channels 44 and 45. FIG. 2 also shows a casino token C12 bypassing the half dollar channel 43.

Figure 14:
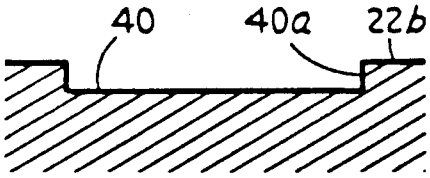
FIG. 14 is an enlarged section taken generally along line 14—14 in FIG. 2.

The cross-sectional profile of the exit channels 40–45 is shown most clearly in FIG. 14, which is a section through the nickel channel 40. Of course, the cross-sectional configurations of all the exit channels are similar; they vary only in their widths and their circumferential and radial positions. Because the channel 40 has a width which is slightly greater than the diameter of the nickel C7, the entire nickel fits into the channel 40. As the nickel is moved circumferentially by the rotating disc, the inner wall 40*a* of the channel 40 guides the nickel outwardly until it reaches the periphery of the guide plate 12 and eventually emerges from between the guide plate and the resilient pad. At this point the momentum of the coin causes it to move away from the sorting head into an arcuate guide which directs the coin toward a suitable receptacle, such as a coin bag or box.

Figure 17A:
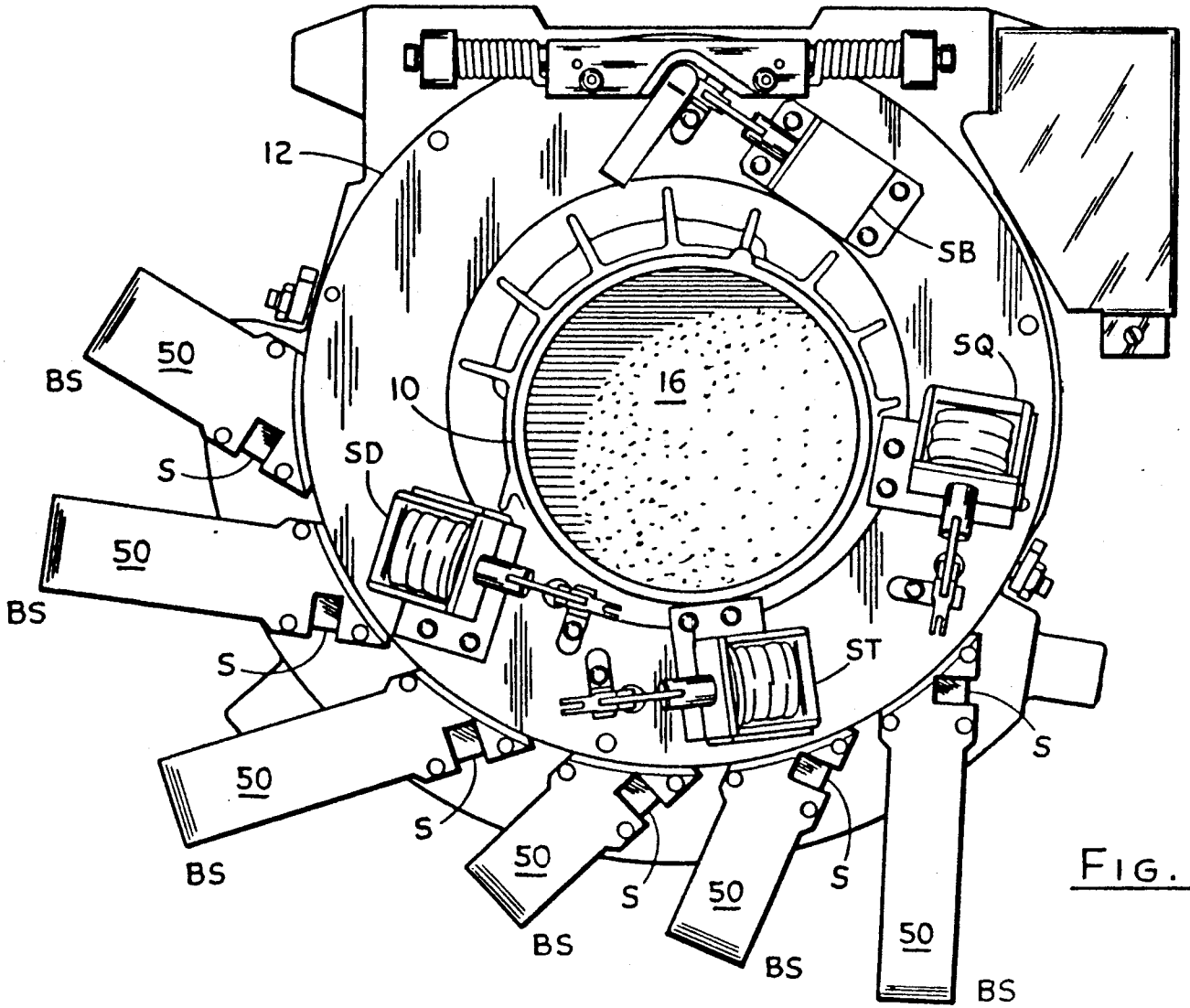
FIG. 17A is a top plan view of the sorting head of FIG. 2, including the bag stations around the sorting head
Figure 17B:
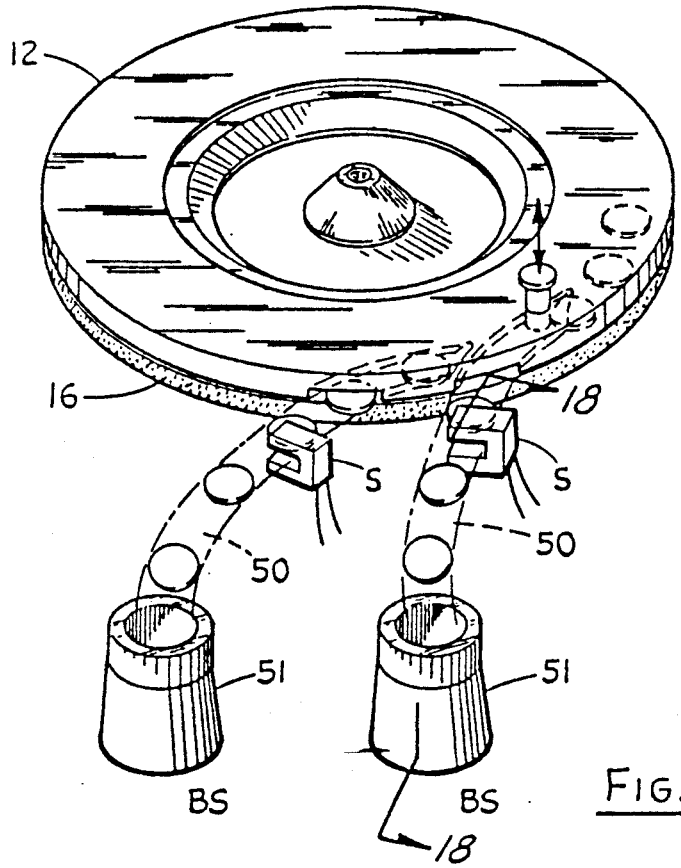
FIG. 17B is a perspective view of a portion of the coin sorter of FIG. 1, showing two of the six coin discharge and bagging stations and certain of the components included in those stations.
Figure 18:
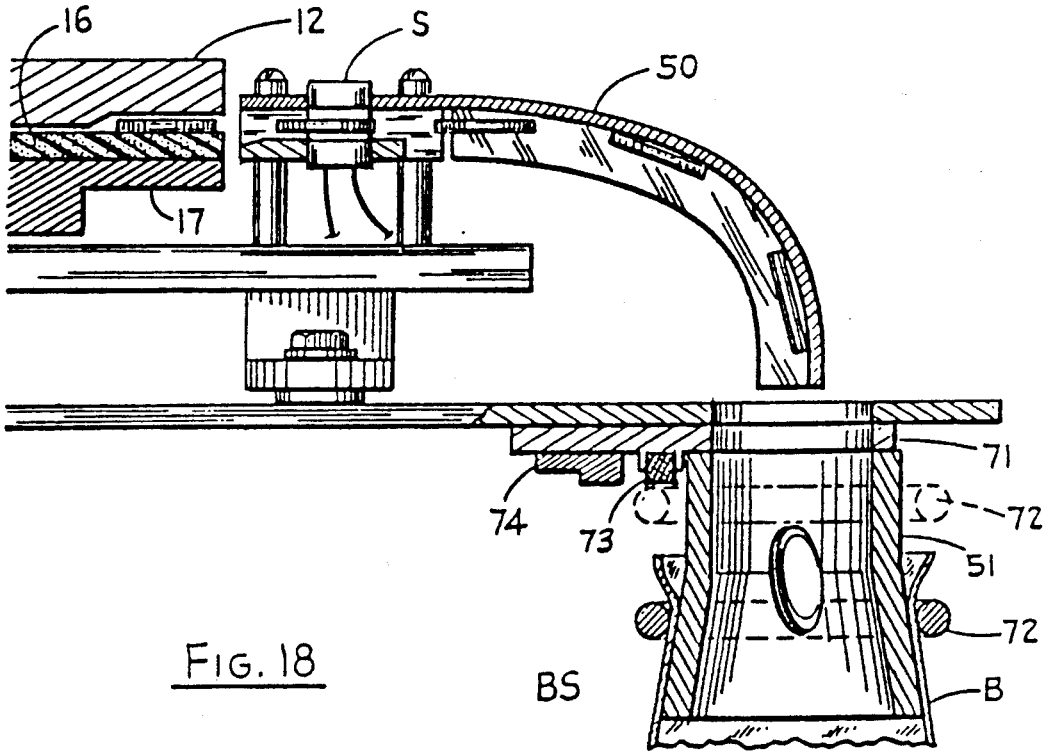
FIG. 18 is an enlarged section taken generally along line 18—18 in FIG. 17 and showing additional details of one of the coin discharge and bagging station.

As coins are discharged from the six exit channels 40–45, the coins are guided down toward six corresponding bag stations BS by six arcuate guide channels 50, as shown in FIGS. 17A, 17B and 18. All six bag stations BS are illustrated in FIG. 17A, only two of the bag stations are illustrated in FIG. 17B, and one of the stations is illustrated in FIG. 18. For the purpose of counting each coin passing through the six guide channels 50, a proximity sensor S is mounted near the inlet of each guide channel. Thus, a total of six proximity sensors S are mounted on the six guide channels 50.

As the coins leave the lower ends of the guide channels 50, they enter corresponding cylindrical guide tubes 51 which are part of the bag stations BS. The lower ends of these tubes 51 flare outwardly to accommodate conventional clamping-ring arrangements for mounting coin bags B directly beneath the tubes 51 to receive coins therefrom.

As can be seen in FIG. 18, each clamping-ring arrangement includes a support bracket 71 below which the corresponding coin guide tube 51 is supported in such a way that the inlet to the guide tube is aligned with the outlet of the corresponding guide channel. A clamping ring 72 having a diameter which is slightly larger than the diameter of the upper portions of the guide tubes 51 is slidably disposed on each guide tube. This permits a coin bag B to be releasably fastened to the guide tube 51 by positioning the mouth of the bag over the flared end of the tube and then sliding the clamping ring down until it fits tightly around the bag on the flared portion of the tube, as illustrated in FIG. 18. Releasing the coin bag merely requires the clamping ring to be pushed upwardly onto the cylindrical section of the guide tube. The clamping ring is preferably made of steel, and a plurality of magnets 73 are disposed on the underside of the support bracket 71 to hold the ring 72 in its released position while a full coin bag is being replaced with an empty bag.

Each clamping-ring arrangement is also provided with a bag interlock switch for indicating the presence or absence of coin bag at each bag station. In the illustrative embodiment, a magnetic reed switch 74 of the "normally-closed" type is disposed beneath the bracket 71 of each clamping-ring arrangement. The switch 74 is adapted to be activated when the corresponding clamping ring 72 contacts the magnets 73 and thereby conducts the magnetic field generated by the magnets 73 into the vicinity of the switch 74. This normally occurs when a previously clamped full coin bag is released and has not yet been replaced with an empty coin bag. A similar mechanism is provided for each of the other bag stations BS.

Figure 3:
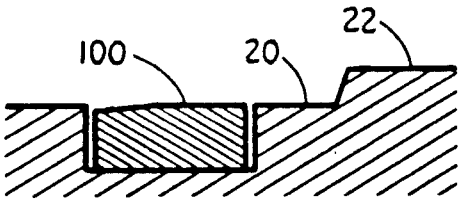
FIG. 3 is an enlarged section taken generally along line 3—3 in FIG. 2.

For the purpose of stopping the sorting and exiting of coins when bags are not available to receive coins of all denominations, the illustrative sorter includes a movable diverter 100 for preventing additional coins from entering the spiral channel 25, and a retractable bridge 101 at the outer end of the spiral channel for directing any coins already in the spiral channel along a recycling edge 102. This "bag stopping" arrangement is similar to that described in Ristvedt et al. U.S. Pat. No. 4,564,036. As can be seen in FIGS. 2 and 3, the leading edges of the diverter 100 and the bridge 101 are chamfered to prevent coins from catching on these edges when the respsective members are in their retracted positions.

In accordance with one aspect of the present invention, two different exit channels are provided for one or more selected coin denominations, and a controllably actuatable shunting device is associated with the first exit channel for shunting coins of the selected denomination past the first exit channel to the second exit channel. Thus, in the illustrative embodiment, two exit channels 41 and 42 are provided for quarters, and two exit channels 44 and 45 are provided for the casino tokens. Consequently, the quarters and casino tokens can each be discharged at two different locations around the periphery of the guide plate 12, i.e., at the outer ends of the channels 41 and 42 for the quarters, and at the outer ends of the channels 44 and 45 for the tokens. In order to select one of the two exit channels available for each of the quarters and casino tokens, a controllably actuatable shunting device is associated with the first of each of the two pairs of similar exit channels 41, 42 and 44, 45. When one of these shunting devices is actuated, it shunts coins of the corresponding denomination from the first to the second of the two exit channels provided for that particular denomination.

Figure 15A:
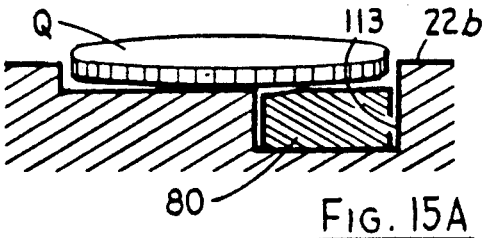
FIG. 15A is an enlarged section taken generally along line 15—15 in FIG. 2, and illustrating a coin in the exit channel with the movable element in that channel in its retracted position.
Figure 15B:
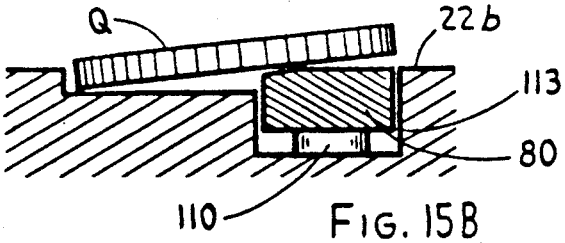
FIG. 15B is the same section shown in FIG. 15A with the movable element in its advanced position.

Turning first to the pair of exit channels 41 and 42 provided for the quarters, a vertically movable bridge 80 is positioned adjacent the inner edge of the first channel 41, at the entry end of that channel. This bridge 80 is normally held in its raised, retracted position by means of a spring 81 (FIG. 19), as will be described in more detail below. When the bridge 80 is in this raised position, the bottom of the bridge is flush with the top wall of the channel 41, as shown in FIG. 15A, so that quarters Q enter the channel 41 and are discharged through that channel in the normal manner. When it is desired to shunt quarters past the first exit channel 41 to the second exit channel 42, a solenoid SQ (FIGS. 17A, 20 and 21) is energized to overcome the force of the spring 81 and lower the bridge 80 to its advanced position. In this lowered position, shown in FIG. 15B, the bottom of the bridge 80 is flush with the lowermost surface 22*b* of the guide plate 12, which has the effect of preventing quarters Q from entering the exit channel 41. Consequently, the quarters are rotated past the exit channel 41 by the rotating disc, sliding across the bridge 80, and enter the second exit channel 42.

Figure 16:
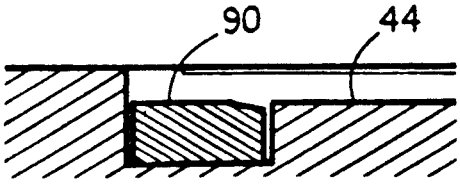
FIG. 16 is an enlarged section taken generally along line 16—16 in FIG. 2.

A vertically movable bridge 90 (FIGS. 2 and 16) located in the first exit channel 44 for the casino tokens operates in the same manner as the bridge 80. Thus, the token bridge 90 is located along the inner edge of the first token exit channel 44, at the entry end of that exit channel. The bridge 90 is normally held in its raised, retracted position by means of a spring. In this raised position the bottom of the bridge 90 is flush with the top wall of the exit channel 44, so that casino tokens enter the channel 44 and are discharged through that channel. When it is desired to divert casino tokens to the second exit channel 45, a solenoid ST (FIG. 17A) is energized to overcome the force of the spring and lower the bridge 90 to its advanced position, where the bottom of the bridge 60 is flush with the lowermost surface 22*b* of the guide plate 1 2 When the bridge 90 is in this advanced position, the bridge prevents any coins or tokens from entering the first exit channel 44. Consequently, the tokens slide across the bridge 90, continue on to the second exit channel 45 and are discharged therethrough. The leading edges of both the bridges 80 and 90 are chamfered to prevent coins from catching on these edges when the bridges are in their retracted positions.

Figure 19:
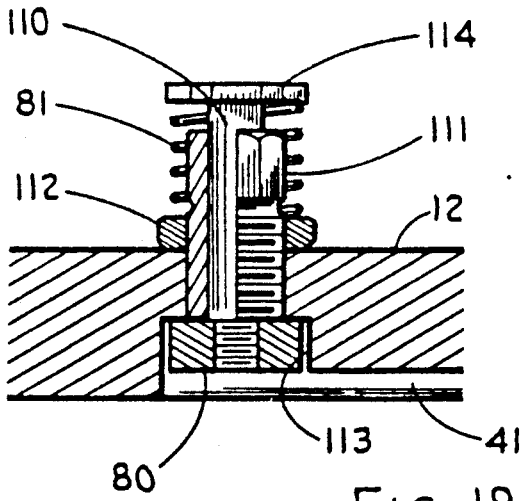
FIG. 19 is a side elevation, partially in section, of one of the vertically movable bridges in the sorter of FIGS. 1-18, and a portion of the actuating mechanism for that bridge.
Figure 20:
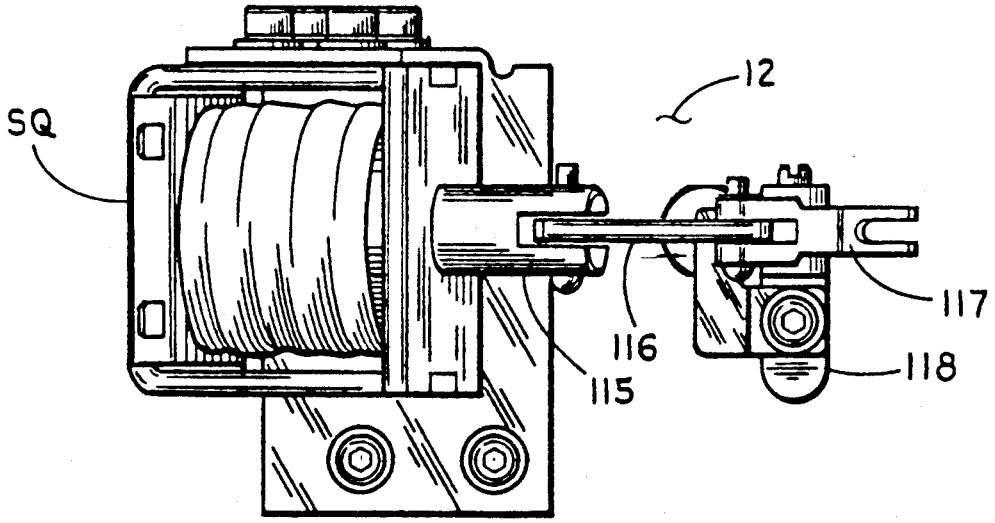
FIG. 20 is a top plan view of the actuating mechanism of FIG. 19 and showing the additional components of that mechanism.
Figure 21:
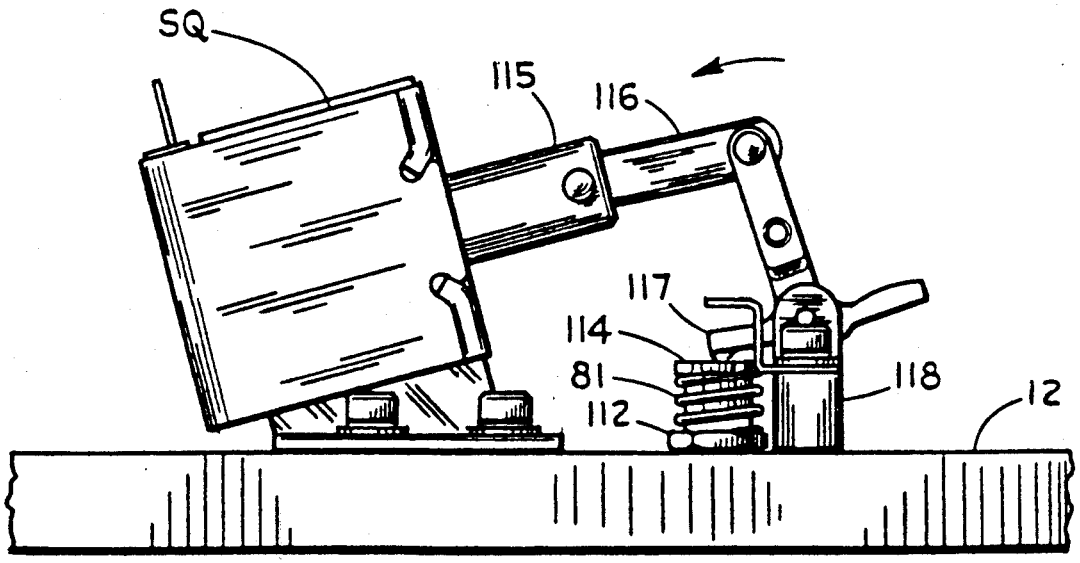
FIG. 21 is a side elevation of the mechanism shown in FIG. 20.

The details of the actuating mechanism for the bridge 80 are illustrated in FIGS. 19–21. The bridge 90 and the diverter 100 have similar actuating mechanisms, and thus only the mechanism for the bridge 80 will be described. The bridge 80 is mounted on the lower end of a plunger 110 which slides vertically through a guide bushing 111 threaded into a hole bored through the guide plate 12. The bushing 111 is held in place by a locking nut 112. A recess 113 is formed in the lower surface of the plate 12 adjacent the lower end of the bushing 111 to receive the bridge 80 when it is in its raised, retracted position. The bridge 80 is normally held in this retracted position by the coil spring 81 compressed between the locking nut 112 and a head 114 on the upper end of the plunger 110. The upward force of the spring 81 holds the bridge 80 against the lower end of the bushing 111.

To advance the plunger 110 to its lowered position within the exit channel 41 (FIG. 15B), the plunger 110 is pushed downwardly with a force sufficient to overcome the upward force of the spring 81. This downward force is produced by the solenoid SQ mounted on the top of the guide plate 12. The movable core 115 of the solenoid is connected to the top of the plunger 110 by means of a link 116 and a lever 117 pivoted on a bracket 118 secured to the plate 12. Thus, when the solenoid 82 is energized, the core 115 is retracted to turn the link 116 counterclockwise (as viewed in FIG. 21) and press the lever 117 downwardly against the plunger 110 to move the plunger, and thus the bridge 80, downwardly until the plunger head 114 engages the top of the bushing 111. The plunger is held in this advanced position as long as the solenoid 82 remains energized, and is returned to its normally raised position by the spring 81 as soon as the solenoid is de-energized.

Figure 22:
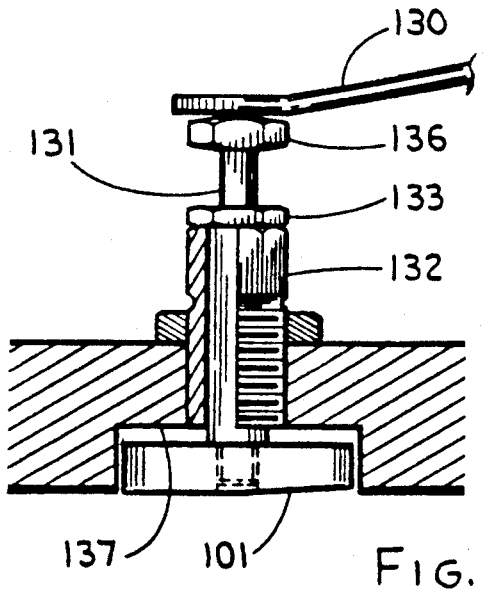
FIG. 22 is a side elevation, partially in section, of one of the vertically movable bridges in the sorter of FIGS. 1-18, and a portion of the actuating mechanism for that bridge.
Figure 23:
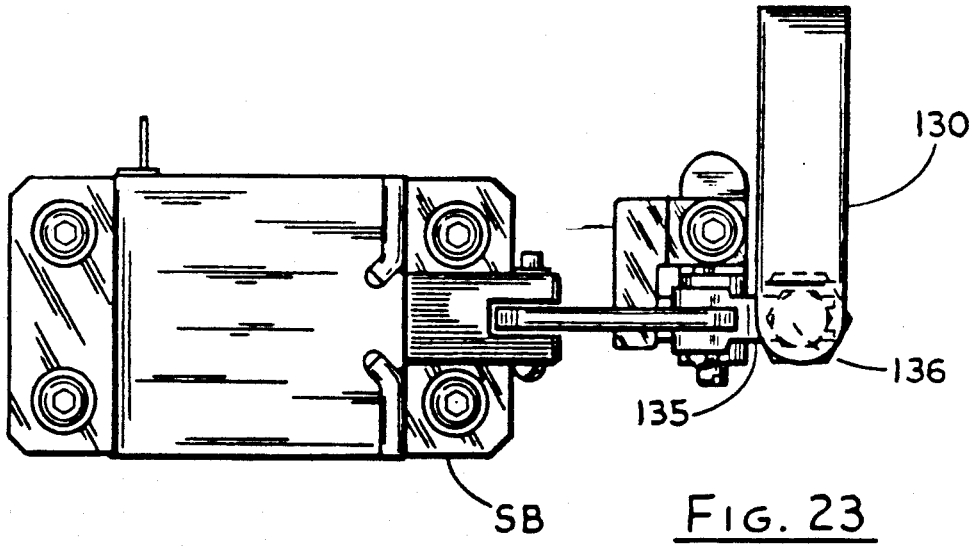
FIG. 23 is a top plan view of the actuating mechanism of FIG. 19 and showing the additional components of that mechanism.
Figure 24:
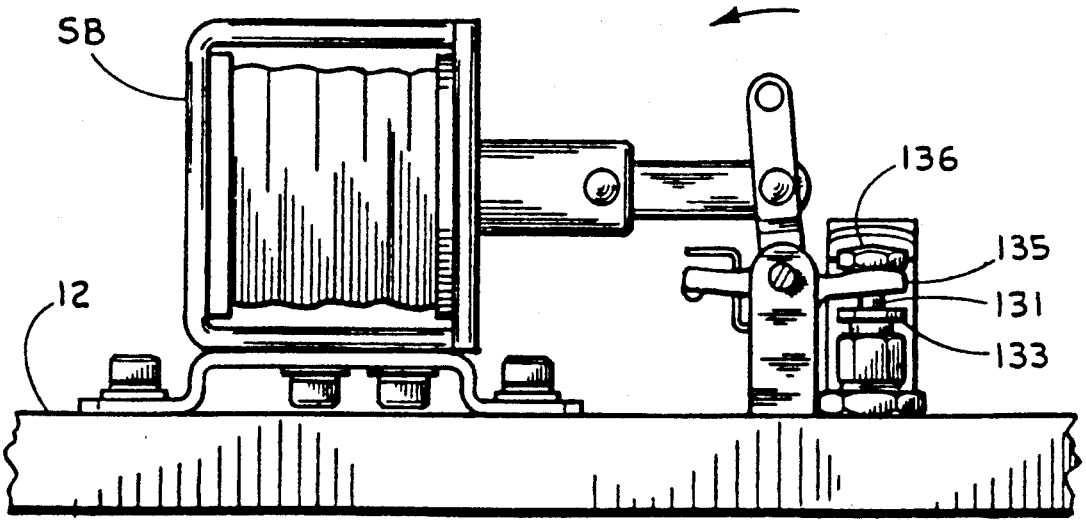
FIG. 24 is a side elevation of the mechanism shown in FIG. 20.

Solenoids ST and SD control the bridge 90 and the diverter 100 in the same manner described above in connection with the bridge 80 and the solenoid SQ. In the case of the bridge 101 that is used during "bag stopping," the coil spring is replaced by a leaf spring 130 (FIGS. 22–24) which constantly forces a plunger 131 downwardly to maintain the bridge 101 in its lowered advanced position within the recess 25*a*. The lower limit of the downward movement of the plunger 131 is fixed by the top of a threaded guide bushing 132 engaging a hexagonal flange 133 on the plunger 131 when the plunger is lowered. When it is desired to retract the bridge 101 for bag stopping, a solenoid 134 is energized to pivot a lever 135 upwardly against the plunger head 136, thereby overcoming the biasing force of the spring 130 and raising the plunger 131. The upper limit of the plunger movement is fixed by the top surface of a recess 137 formed in the upper surface of the recess 25*a* for receiving the bridge 101.

Returning now to the function of the land 23, the primary function of this portion of the guide plate 12 is to prevent two or more coins stacked on top of each other from reaching the ramp 28. When two or more coins are stacked on top of each other, they may be pressed into the resilient pad 16 even within the deep peripheral channel 20. Consequently, stacked coins can be located at different radial positions within the channel 20 as they approach the land 23. When such a pair of stacked coins has only partially entered the channel 20, they engage the ramp 23*a* on the leading edge of the land 23. The ramp 23*a* presses the stacked coins downwardly into the resilient pad 16, which retards the lower coin while the upper coin continues to be advanced. Thus, the stacked coins are stripped apart so that they can be recycled and once again enter the channel 20, this time in a single layer.

When a stacked pair of coins has moved out into the channel 20 before reaching the land 23, the stacked coins engage the beveled outer wall 23*b* of the land 23. Thus, the upper coin in the stacked pair is cammed outwardly into the channel 25, and the lower coin is pressed into the resilient pad 16 so that it can pass beneath the land 23. Pressure between the land 23 and the resilient pad 16 maintains the lower coin in a fixed radial position as it passes beneath the land 23 so that this coin is recycled into the channel 20 as the pad continues to rotate. Thus, the two coins are stripped apart with the upper coin moving outwardly to the guide wall 27 and onto the ramp 28, while the lower coin is recycled.

Figure 25:
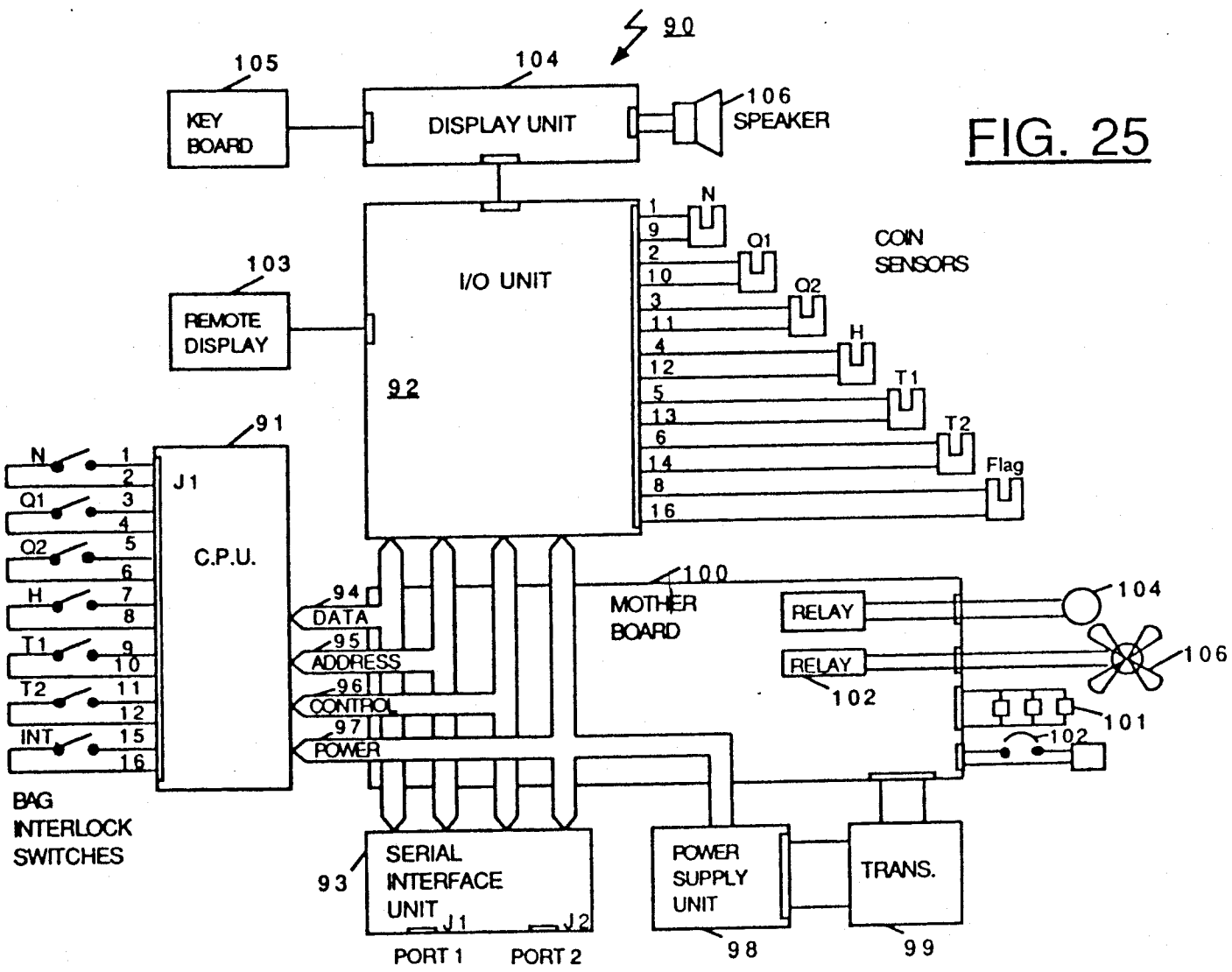
FIG. 25 is a block diagram of an electrical control system for controlling the sorter of FIGS. 1-24, and providing the necessary interfaces between the control system and the operator of the sorter.

Referring now to FIG. 25, there is shown an upper level block diagram of an illustrative microprocessor-based control system 90 for controlling the operation of coin sorter incorporating the bag-switching system of this invention. The control system 90 includes a central processor unit (CPU) 91 for monitoring and regulating the various parameters involved in the coin sorting-/counting and bag-switching operations. The CPU 91 accepts signals from (1) the bag-interlock switches 74 which provide indications of the positions of the bag-clamping rings 72 which are used to secure coin bags B to the six coin guide tubes 51, to indicate whether or not a bag is available to receive each coin denomination, and (2) switches which indicate whether the four solenoids SQ, ST, SB and SD are energized or de-energized. The CPU 91 is also linked to an input/output (I/O) unit 92 and a serial interface unit 93 through a data bus 94, an address bus 95, and a control bus 96. The I/O unit 92, the CPU 91, and the serial interface unit 93 are all supplied with power through a power line 97 fed by a power supply unit 98. The power supply unit 98 also serves, through appropriate transformer means 99, as the source of power for a mother board 100 which houses additional control components necessary for regulating the operation of the coin sorter. The mother board 100 is also linked to a plurality of solenoids 101 used for various machine operations and a circuit breaker 102 for providing surge protection.

The I/O unit 92 provides the interface between the CPU 91 and the external world and may be linked to a remote display unit 103. The I/O unit 92 is usually linked to a display unit 104 for providing a visual indication of various machine parameters, an associated keyboard 105 for accepting user commands, and a speaker unit 106 for providing audible alarms. The I/O unit 92 is also linked to the six coin sensors S located adjacent the outboard ends of the six exit channels 40–45, respectively. As mentioned previously, the signals from these sensors S are used to separately count the number of coins discharged from each separate exit channel.

During operation, the CPU 91 is programmed in such a way that the sorting/counting process is enabled only when certain combinations of conditions are satisfied. Sorting and counting are initiated concurrently, and each sorted coin is directed to the corresponding exit channel where it is sensed and counted. The CPU is also programmed to display the individual count for each coin exit channel and, if desired, to provide count totals for a batch of coins, for coin subbatches, etc. The CPU controls the bag-switching system by regulating the energization and de-energization of the solenoids SQ and ST that control the positions of the two bag-switching bridges 80 and 90.

Since the bag-interlock switches 74 are of the "normally-closed" type, each switch is closed when the corresponding clamping ring 72 is in its secured position and is opened when the ring is moved up into the release position. The resulting signals generated by the switches ar processed by the CPU board and used as a basis for regulating the bag-switching and counting operations on the basis of preprogrammed instructions.

The coin count for the bag that receives quarters from the exit channel 41 is displayed when the bridge 80 is retracted. When the bridge 80 is in the advanced position, the coin count for the bag that receives quarters from the exit channel 42 is displayed. The count display for the casino tokens discharged from the exit channels 44 and 45 is the same except that it is determined by the position of the bridge 90.

Figure 26:
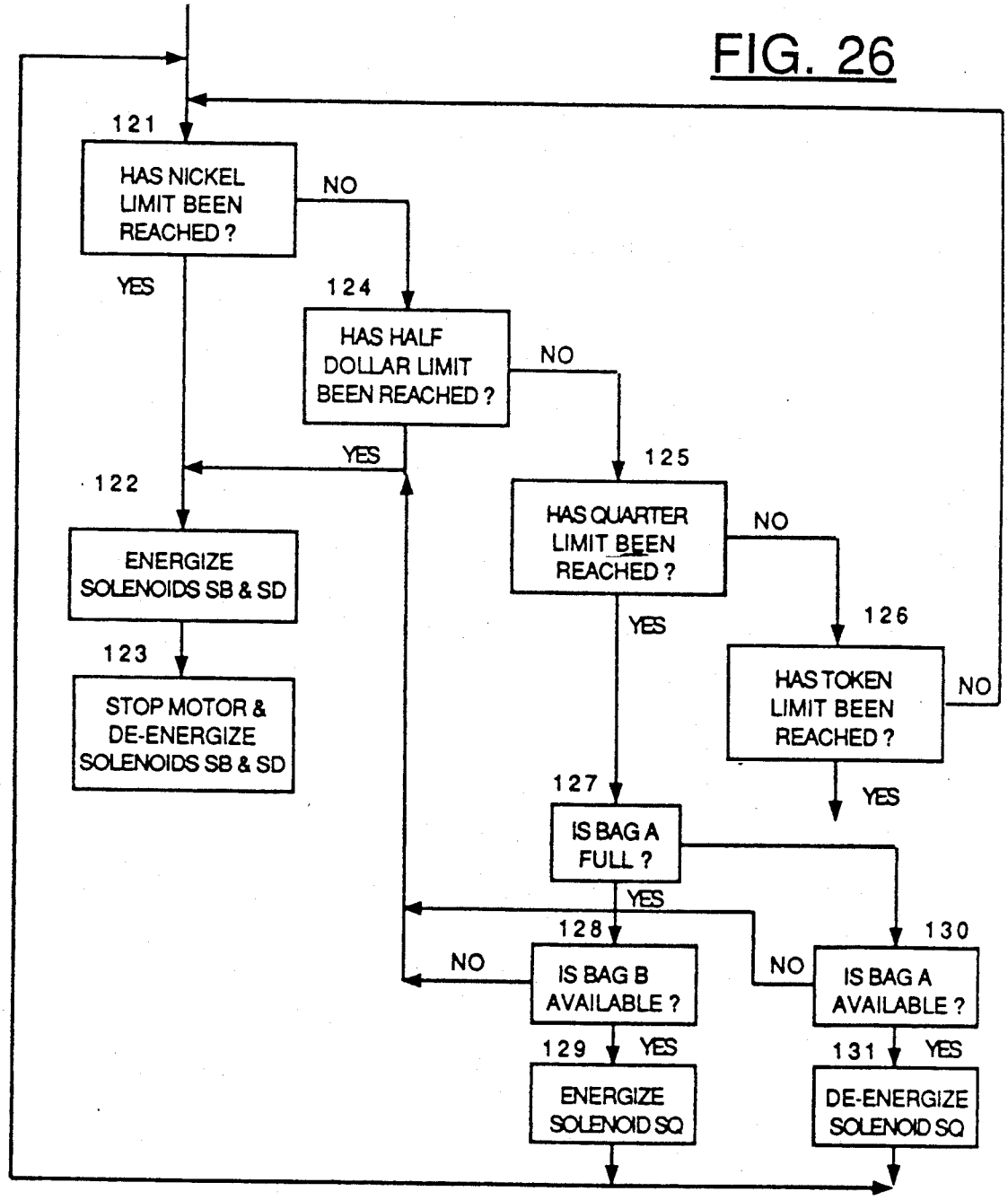
FIG. 26 is a flow chart of a portion of a program for controlling the operation of the microprocessor included in the control system of FIG. 25.

Referring now to FIG. 26, there is shown a flow chart 120 illustrating the sequence of operations involved in utilizing the bag-switching system of this invention in conjunction with the microprocessor-based system discussed above with respect to FIG. 25. The program steps for the processing of the coin tokens are the same as those for the processing of the quarters, and thus only that portion of the program which controls the processing of the quarters is illustrated in FIG. 26.

While the sorter is running, the program repeatedly interrogates the counter to determine whether an operator-set limit has been reached for any of the four different denominations of coins being sorted and counted. Thus, at step 121 the program determines whether the preset count limit for nickels has been reached. If the answer is affirmative, the program advances to step 122 where the "bag stop" solenoids SD and SB are energized. These are the solenoids that advance the diverter 100 and retract the bridge 101. The program then proceeds to step 123, where it stops the drive motor for the sorter and then de-energizes the solenoids SB and SD. The sorter is re-started when the bag-interlock switch for the nickel bag indicates that the full bag has been removed and replaced with an empty bag.

If a negative answer is obtained at step 121, indicating that the count limit has not yet been reached for the nickels, the program advances to step 124 where it determines whether the half dollar count limit has been reached. If the answer at step 124 is affirmative, the program again proceeds to steps 122 and 123 as described above. A negative response at step 124 advances the program to step 125 where it determines whether the count limit has been reached for quarters. If the answer is negative, the program proceeds to step 126 where the same determination is made for the casino tokens. If the answer at 126 is also negative, the system returns to step 121 and repeats the interrogation sequence.

An affirmative response at either step 125 or step 126 advances the program to step 127 to determine whether the bag containing the preset number of coins is bag A or bag B. In the case of the quarters, bag A is the bag that receives quarters from exit channel 41, while the bag that receives quarters from the exit channel 42 is bag B. If step 127 determines that it is bag A that contains the preset number of coins, the system proceeds to step 128 to determine whether bag B is available. If the answer is negative, indicating that bag B is not available, then there is no bag available for receiving quarters and the sorter must be stopped. Accordingly, the system proceeds to steps 122 and 123 to stop the sorter. An affirmative answer at step 128 indicates that bag B is available, and thus the system proceeds to step 129 where the solenoid SQ is energized to advance the bridge 80 to its lowered position. This causes the quarters to be shunted past the exit channel 41 into the exit channel 42 so that they are discharged into bag B. The program then returns to the sequential interrogation process at step 121 to determine when a count limit has been reached.

A negative answer in step 127 indicates the full bag is bag B rather than bag A, and thus the system proceeds to step 130 to determine whether bag A is available. If the answer is negative, it means that neither bag A nor bag B is available to receive the quarters, and thus the sorter is stopped by advancing to steps 122 and 123. An affirmative answer at step 130 indicates that bag A is, in fact, available, and thus the system proceeds to step 131 to de-energize the solenoid SQ which controls the bridge 80. De-energizing the solenoid SQ causes the bridge 80 to be retracted by its return spring 81 so that coins enter the first exit channel 41.

I claim:

1. A coin sorting apparatus for receiving and sorting mixed coins by denomination, said apparatus comprising a rotatable disc having a resilient surface for receiving said mixed denomination coins and imparting rotational movement to said mixed denomination coins, means for rotating said disc, a stationary guide plate having a contoured surface spaced slightly away from and generally parallel to said resilient surface of said rotatable disc, said guide plate including means for queuing the coins on said disc into a single file of coins, and a guiding edge which engages selected edges of the coins in said single file and guides said coins along a prescribed path where the positions of the edges of the engaged coins are determined by the diameters of the respective coins, sorting means for discriminating among coins of different denominations and selecting coins of different denominations for discharge from said rotating disc at different locations around the periphery of said stationary guide plate, said sorting means including at least two different selecting means for a prescribed coin denomination for discharging coins of that prescribed denomination at two different locations around the periphery of said guide plate, and controllably actuatable shunting means associated with the first of said two different selecting means for shunting coins of said prescribed denomination past the first of said two different selecting means to the second of said two different selecting means so that said coins are discharged at the second of said two different locations.

2. The coin sorting apparatus of claim 1 wherein said shunting means is moveable between a first position in which the shunting means is inoperative so that coins of said prescribed denomination are discharged at the first of said two different locations, and a second position in which the shunting means is operative to shunt coins of said prescribed denomination past the first of said two different selecting means so that said coins are discharged at the second of said two different selecting means.

3. The coin sorting apparatus of claim 1 wherein at least the first of said two different selecting means comprises means for positioning an edge of each coin of said prescribed denomination at a radial position different from the radial position of the corresponding edges of coins of all other denominations, and said shunting means comprises means for retracting said positioning means to an inoperative position.

4. The coin sorting apparatus of claim 1 which includes a plurality of counting means for separately counting coins discharged at said two different locations, and control means operatively connected to said counting means and said shunting means for actuating said shunting means in response to the counting of a preselected number of coins at one of said two different locations.

5. The coin sorting apparatus of claim 1 wherein said selecting means comprises a plurality of exit channels formed by said guide plate and spaced around the periphery thereof with the inner ends of said channels located at different radial positions for receiving and discharging coins of different denominations, and said shunting means comprises a retractable bridge disposed within the first of two different exit channels for coins of said prescribed denomination, at the inner end of said first channel, said bridge preventing the entry of coins into said first channel when said bridge is in its advanced position.

6. The coin sorting apparatus of claim 1 which includes a plurality of counting means for separately counting coins discharged at each of said different locations, means for stopping the rotation of said disc in response to the counting of a preselected number of coins of other than said prescribed denomination at one of said locations, and at the same time diverting coins inwardly from said sorting means to prevent the further discharge of coins, and means for actuating said shunting means, and continuing the rotation of said disc, in response to the counting of a prescribed number of coins of said prescribed denomination.

7. The coin sorting apparatus of claim 6 which includes means for indicating the absence of an empty coin receptacle for receiving coins at each of said two locations for the discharge of coins of said prescribed denominations, and means for stopping the rotation of said disc in response to the combination of (1) the counting of a prescribed number of coins of said prescribed denomination at one of said two different locations, and (2) the absence of an empty coin receptacle at the other of said two different locations.

8. The coin sorting apparatus of claim 1 which includes a plurality of counting means for separately counting coins discharged at each of said different locations, means responsive to said counting means for (1) stopping the rotation of said disc in response to the counting of a prescribed number of coins of a denomination other than said prescribed denomination, and (2) actuating said shunting means in response to the counting of a prescribed number of coins of said prescribed denomination.

* * * * *